US011097555B2

(12) United States Patent
Takeuchi

(10) Patent No.: US 11,097,555 B2
(45) Date of Patent: Aug. 24, 2021

(54) PRINTING APPARATUS AND CONTROL METHOD OF PRINTING APPARATUS

(71) Applicant: SEIKO EPSON CORPORATION, Tokyo (JP)

(72) Inventor: Katsuo Takeuchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/738,259

(22) Filed: Jan. 9, 2020

(65) Prior Publication Data

US 2020/0223231 A1 Jul. 16, 2020

(30) Foreign Application Priority Data

Jan. 11, 2019 (JP) ..... JP2019-003736

(51) Int. Cl.
*B41J 2/355* (2006.01)
*B41J 2/375* (2006.01)
*G05F 1/56* (2006.01)

(52) U.S. Cl.
CPC ..... *B41J 2/3558* (2013.01); *B41J 2/355* (2013.01); *B41J 2/3553* (2013.01); *B41J 2/375* (2013.01); *G05F 1/56* (2013.01)

(58) Field of Classification Search
CPC ..... B41J 2/3558; B41J 2/3553; B41J 2/355; B41J 2/375; B41J 2/36; G05F 1/56
See application file for complete search history.

(56) References Cited

U.S. PATENT DOCUMENTS 7,547,087 B2 * 6/2009 Cato ..... B41J 2/0451 347/19
2017/0157948 A1 6/2017 Uno et al.

FOREIGN PATENT DOCUMENTS

JP 2000141730 5/2000
JP 2017124543 7/2017
JP 2017149050 8/2017

* cited by examiner

*Primary Examiner* — Geoffrey S Mruk
(74) *Attorney, Agent, or Firm* — Workman Nydegger

(57) ABSTRACT

The thermal printer includes a heating element, and a voltage supply circuit that supplies a drive voltage and a test voltage to the heating element. The voltage supply circuit includes a drive voltage supply circuit that is coupled to the heating element and that turns ON the supply of the drive voltage to the heating element, a test voltage supply circuit that is coupled to the heating element and that turns ON the supply of the test voltage to the heating element, a drive voltage stop circuit setting the supply of the drive voltage of the drive voltage supply circuit OFF, and a test voltage stop circuit setting the supply of the test voltage of the test voltage supply circuit OFF.

7 Claims, 7 Drawing Sheets

PRINTING APPARATUS AND CONTROL METHOD OF PRINTING APPARATUS

The present application is based on, and claims priority from JP Application Serial Number 2019-003736, filed Jan. 11, 2019, the disclosure of which is hereby incorporated by reference herein in its entirety.

BACKGROUND

1. Technical Field

The present disclosure relates to a printing apparatus and a method of controlling the printing apparatus.

2. Related Art

In the related art, printing apparatuses that perform printing or a test of a head element by supplying a voltage to the head element included in the print head are known. For example, JP-A-2000-141730 discloses a printing apparatus that supplies a printing voltage to a head element made of a resistor and performs a defect test of the head element based on a divided voltage obtained from the head element and a test resistor.

The printing apparatus as described in JP-A-2000-141730 may be configured to be able to supply different valued voltages to the head element, and may supply a plurality of voltages having different voltage values to the head element simultaneously.

SUMMARY

According to an aspect of the present disclosure, a printing apparatus includes a print head including a head element, and a voltage supply circuit configured to supply, to the head element, a first voltage and a second voltage lower than the first voltage, wherein the voltage supply circuit includes a first voltage supply circuit that is coupled to the head element and that turns ON a supply of the first voltage to the head element in response to an input of a first signal, a second voltage supply circuit that is coupled to the head element and that turns ON a supply of the second voltage to the head element in response to an input of a second signal, a first voltage stop circuit setting a supply of the first voltage of the first voltage supply circuit OFF in response to an input of the second signal, and a second voltage stop circuit setting a supply of the second voltage of the second voltage supply circuit OFF in response to an input of the first signal.

The printing apparatus may include a first delay circuit delaying an input of the first signal to the first voltage supply circuit.

The printing apparatus may include a second delay circuit delaying an input of the second signal to the second voltage supply circuit.

The printing apparatus may be configured such that the voltage supply circuit is coupled to a first voltage supply line to which the first voltage is supplied and a second voltage supply line for supplying the second voltage, wherein the first voltage supply circuit includes a first switch turning ON in response to the first signal and couples the head element to the first voltage supply line when the first switch is in an ON state, wherein the second voltage supply circuit includes a second switch turning ON in response to the second signal and couples the head element to the second voltage supply line when the second switch is in an ON state, wherein the first voltage stop circuit sets the first switch OFF in response to an input of the second signal, and wherein the second voltage stop circuit sets the second switch OFF in response to an input of the first signal.

The printing apparatus may be configured such that the first switch is composed of a first field effect transistor, and wherein the first voltage stop circuit sets the first field effect transistor OFF when an input of the second signal is in an ON state.

The printing apparatus may be configured such that the second switch is composed of a second field effect transistor, and wherein the second voltage stop circuit sets the second field effect transistor OFF when an input of the first signal is in an ON state.

The printing apparatus may be configured such that the first switch and the second switch are coupled to a common contact coupled to the head element.

The printing apparatus may include a control circuit controlling the first signal and the second signal each of which is input to the voltage supply circuit.

According to another aspect of the present disclosure, a method of controlling a printing apparatus including a print head includes supplying a first voltage from a voltage supply circuit to a head element of the print head to perform printing, and supplying a second voltage lower than the first voltage to test the head element, wherein the voltage supply circuit turns ON a supply of the first voltage to the head element in response to an input of the first signal and sets a supply of the second voltage OFF, and turns ON a supply of the second voltage to the head element in response to an input of the second signal and sets a supply of the first voltage OFF.

DESCRIPTION OF EXEMPLARY EMBODIMENTS

1. Thermal Printer Configuration

Figure 1:
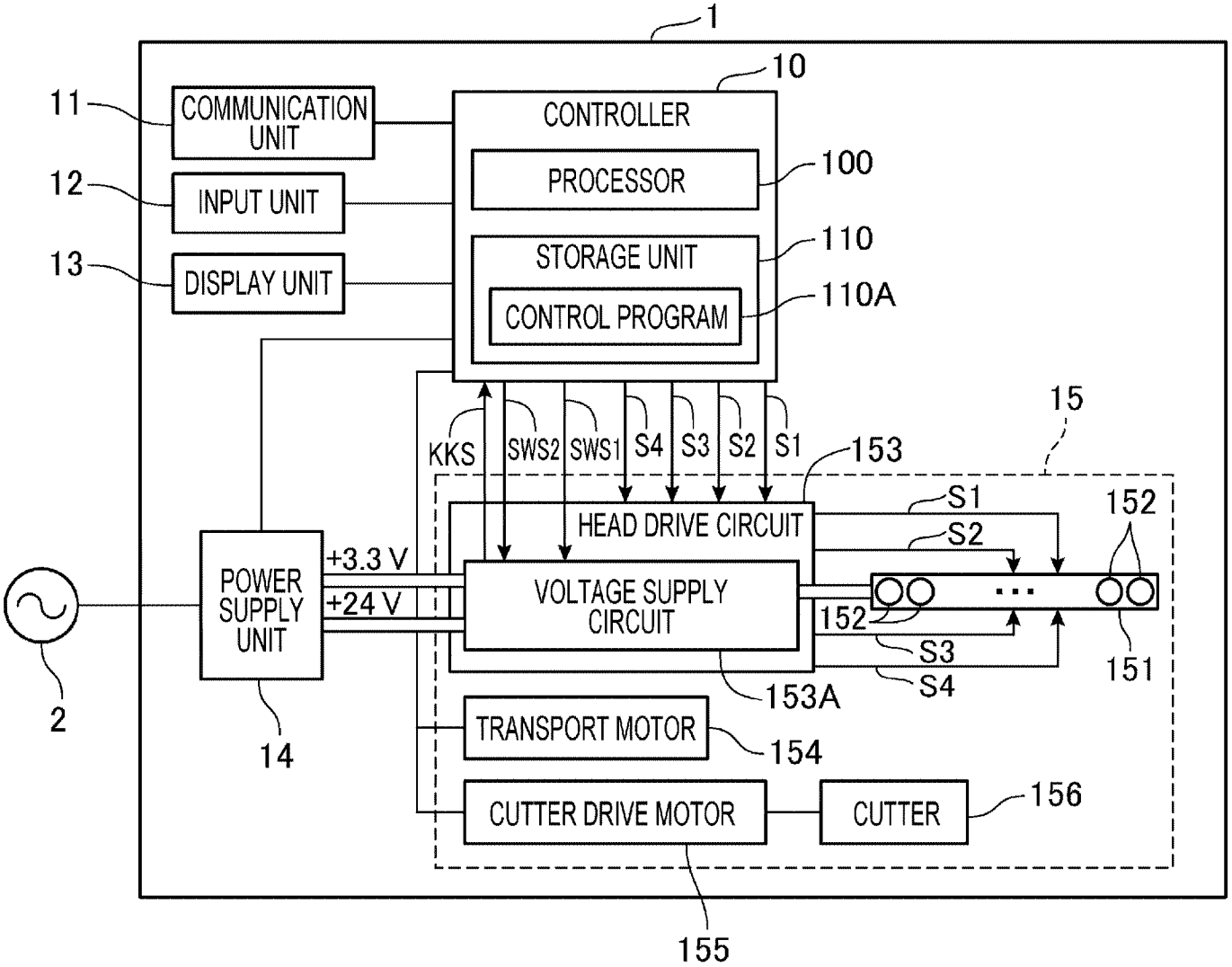
FIG. 1 is a diagram showing a configuration of a thermal printer.

FIG. 1 is a diagram illustrating a configuration of a thermal printer 1. The thermal printer 1 corresponds to an example of the printing apparatus.

The thermal printer 1 is a printing apparatus that stores thermal roll paper (not shown) as a printing medium in a main body, and forms dots by applying heat to the printing surface of the thermal roll paper with a line-type thermal head 151 provided with heating elements 152 arranged side by side to prints characters, images, and the like. The heating element 152 corresponds to an example of the head element. The thermal head 151 corresponds to an example of the print head.

The thermal printer 1 includes a controller (control circuit) 10, a communication unit 11, an input unit (input device) 12, a display unit (display device) 13, a power supply unit (power supply circuit) 14, and a printing unit (printing mechanism) 15.

The controller 10 includes a processor 100 that executes programs of a CPU, an MPU and the like, and a storage unit 110, and is a circuit controlling respective units of the thermal printer 1. The controller 10 performs various processes in cooperation with hardware and software so that the processor 100 reads a control program 110A stored in the storage unit 110 and executes the processes.

The storage unit (memory) 110 has a storage area for storing a program executed by the processor 100 and data processed by the processor 100. The storage unit 110 stores the control program 110A executed by the processor 100 and other various data. The storage unit 110 has a nonvolatile storage area for storing programs and data in a nonvolatile manner. Further, the storage unit 110 may include a volatile storage area and may constitute a work area that temporarily stores a program executed by the processor 100 and data to be processed.

The communication unit 11 is configured by communication hardware according to a predetermined communication standard, and communicates with an external device such as a host computer according to the predetermined communication standard under the control of the controller 10. Examples of the communication hardware include hardware such as a communication circuit, a communication port, a communication board, and a communication connector.

The input unit 12 includes an input device such as an operation panel or a touch panel provided in the thermal printer 1, detects an operation performed by the user on the input device, and outputs the detected operation to the controller 10. The controller 10 performs a process corresponding to the operation on the input device based on the input from the input unit 12.

The display unit 13 includes a display device such as a plurality of LEDs and a display panel, and turns ON/OFF the LEDs in a predetermined manner and displays information on the display panel under the control of the controller 10.

The power supply unit 14 is coupled to a commercial AC power supply 2, and includes a circuit that performs processing such as rectification, smoothing, and voltage conversion on the power supplied from the commercial AC power supply 2, and generates the power supplied to respective units of the thermal printer 1. For example, the power supply unit 14 generates 3.3 volt or 5.0 volt DC power for a logic circuit from the commercial AC power supply 2 and supplies the generated dc power to respective units constituting the controller 10. The power supply unit 14 generates a drive voltage for driving the heating element 152 when printing is performed by the thermal head 151, and supplies the generated drive voltage to a head drive circuit 153. The drive voltage corresponds to an example of the first voltage. The drive voltage is, for example, a voltage of 12 volts or 24 volts. Further, the power supply unit 14 generates a dedicated test voltage for testing a heat generation failure of the heating element 152 included in the thermal head 151, and supplies the generated test voltage to the head drive circuit 153. The test voltage corresponds to an example of the second voltage. The test voltage is lower than the drive voltage, and for example, a voltage for a logic circuit of 3.3 volts or 5.0 volts. In the following description, the test of the heat generation failure of the heating element 152 is referred to as a "heating element test".

The printing unit 15 performs printing based on the print data received from the external device with a supply of the drive voltage from the power supply unit 14 under the control of the controller 10. The printing unit 15 includes the thermal head 151, the head drive circuit 153, a transport motor 154, a cutter drive motor 155, and a cutter 156. The configuration of the thermal head 151 will be described later with reference to FIG. 2.

The head drive circuit 153 inputs signals and supplies a voltage to the thermal head 151 under the control of the controller 10. The head drive circuit 153 outputs a strobe signal S1, a latch signal S2, a clock signal S3, and a data signal S4 input from the controller 10 to the thermal head 151. The head drive circuit 153 includes a voltage supply circuit 153A. The voltage supply circuit 153A corresponds to an example of the voltage supply unit. A drive voltage switch signal SWS1 and a test voltage switch signal SWS2 are input from the controller 10 to the voltage supply circuit 153A. The drive voltage switch signal SWS1 is a signal for turning ON/OFF the supply of the drive voltage to the heating element 152, and corresponds to an example of the first signal. The test voltage switch signal SWS2 is a signal for turning ON/OFF the supply of the test voltage to the heating element 152, and corresponds to an example of the second signal. The configuration of the voltage supply circuit 153A will be described later with reference to FIG. 2.

The transport motor 154 rotates a transport roller (not shown) and transports the thermal roll paper in the transport direction under the control of the controller 10.

The cutter drive motor 155 is coupled to the cutter 156 constituted by a movable blade and a fixed blade, and drives the movable blade to slide toward the fixed blade to cut the thermal roll paper at a predetermined position under the control of the controller 10.

Next, the configuration of the voltage supply circuit 153A will be described. The configuration of the thermal head 151 together with the configuration of the voltage supply circuit 153A will be described.

2. Configurations of Voltage Supply Circuit and Thermal Head

Figure 2:
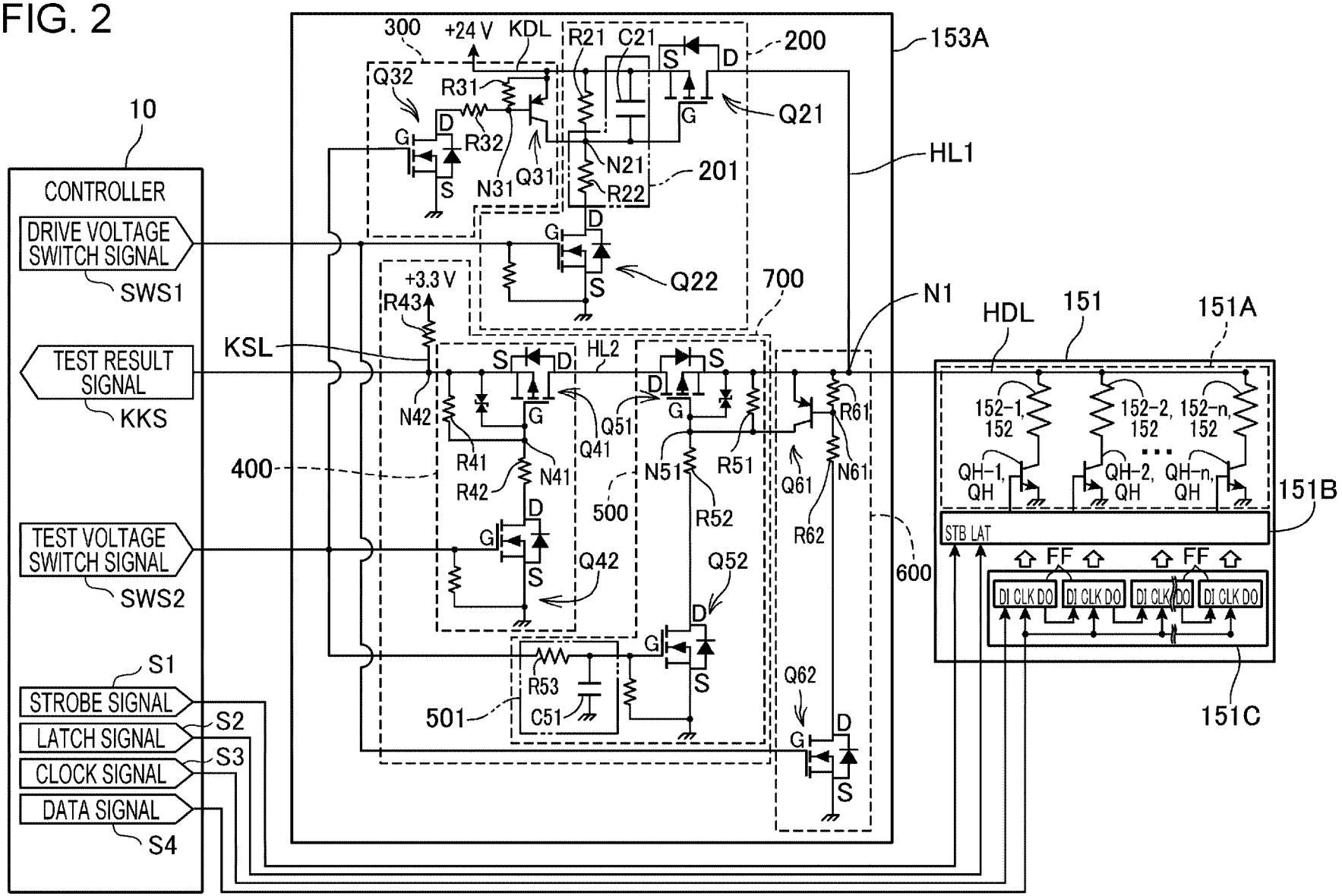
FIG. 2 is a diagram showing a configuration of a voltage supply circuit.

FIG. 2 is a diagram illustrating a configuration of the voltage supply circuit 153A. In FIG. 2, for convenience of explanation, the thermal head 151 and the controller 10 are shown together with the voltage supply circuit 153A.

2-1. Configuration of Thermal Head

First, the configuration of the thermal head 151 will be described. The thermal head 151 includes a heating element unit 151A, a latch driver 151B, and a shift register 151C.

The heating element unit 151A has a plurality of heating elements 152 arranged in a direction intersecting with the transport direction of the thermal roll paper. An example of the intersecting direction is a direction orthogonal to the transport direction. In FIG. 2, the heating element unit 151A has n heating elements 152. "N" is a natural number. Further, the heating element unit 151A includes transistors QH that turn ON/OFF the energization of the heating elements 152 where the number of the transistors QH is equal to the number of heating elements 152. Each of the heating elements 152 has one end coupled to a head voltage supply line HDL and the other end coupled to a collector of a corresponding transistor QH. Each of the transistors QH has an emitter grounded and a base coupled to the shift register 151C. The n transistors QH can selectively energize some of the n heating elements 152 with turning ON/OFF of the respective n transistors QH.

In the following description, the fact that a transistor is turned ON indicates, regardless of the reference sign, that a conductive state is established between the source and drain of the transistor or between the collector and emitter of the transistor. In addition, the fact that a transistor is turned OFF indicates that the transistor is in a non-conductive state in which a conductive state is not established between the source and drain of the transistor or between the collector and emitter of the transistor.

The latch driver 151B includes an input terminal STB to which the strobe signal S1 is input and an input terminal LAT to which the latch signal S2 is input. The latch driver 151B temporarily latches the data signal S4 input from the shift register 151C with the latch signal S2 input to the input terminal LAT. The latch driver 151B controls ON/OFF of the transistor QH based ON the strobe signal S1 input to the input terminal STB, thereby controlling the heat generation of each of the heating elements 152 included in the heating element unit 151A.

The shift register 151C is configured by n stages of flip-flops FF. "N" is a natural number. Each flip-flop FF of the shift register 151C has an input terminal DI to which the data signal S4 as serial data is input, an input terminal CLK to which the clock signal S3 synchronized with the data signal S4 is input, and an output terminal DO from which the data signal S4 overflowing from the flip-flop FF is output. The shift register 151C is configured by sequentially coupling n flip-flops FF so that the output terminal DO of the first-stage of the flip-flop FF and the input terminal DI of the second-stage of the flip-flop FF are coupled.

Here, the operation of the thermal head 151 when printing is performed will be described. In this description, it is assumed that a drive voltage is supplied from the voltage supply circuit 153A to each heating element 152 of the thermal head 151.

When a print execution trigger occurs, the controller 10 of the thermal printer 1 outputs the clock signal S3 corresponding to the number of heating elements 152 to the shift register 151C via the head drive circuit 153, and outputs the data signal S4 indicating print data for one dot line to the first stage of the first flip-flop FF of the shift register 151C in synchronization with the clock signal S3. The data signal S4 indicating the print data is serial data. Therefore, the print data output to the shift register 151C is shifted from the first stage to the n-th stage. The dot line indicates data or an image unit corresponding to a row of the heating elements 152 included in the heating element unit 151A of the thermal head 151.

When the output of the print data for one dot line is completed, the controller 10 outputs the latch signal S2 to the latch driver 151B. When the latch signal S2 is input from the controller 10 via the head drive circuit 153, the latch driver 151B temporarily latches print data for one dot line input to the shift register 151C as parallel data. At this time, since the shift register 151C does not need to hold the print data input to the shift register 151C, the next print data is input.

When the latch driver 151B temporarily latches print data for one dot line, the controller 10 outputs the strobe signal S1 to the latch driver 151B. The latch driver 151B turns ON the transistor QH corresponding to the heating element 152 to be energized based on the latched print data for one dot line when the strobe signal S1 is being output. As a result, the heating element 152 corresponding to the print data generates heat, and printing based on the print data for one dot line is performed on the thermal roll paper. When printing based on the print data for one dot line is performed on the thermal roll paper, the thermal roll paper is transported for one dot line, and the head drive circuit 153 repeats the above-described operation again and perform printing sequentially for each dot line.

2-2. Configuration of Voltage Supply Circuit

Next, the voltage supply circuit 153A will be described. The voltage supply circuit 153A includes a drive voltage supply circuit 200, a drive voltage stop circuit 300, a test voltage supply switching circuit 400, a backflow prevention circuit 500, and a test voltage stop circuit 600. The test voltage supply switching circuit 400 and the backflow prevention circuit 500 constitute a test voltage supply circuit 700.

The drive voltage supply circuit 200 corresponds to an example of the first voltage supply circuit. The drive voltage stop circuit 300 corresponds to an example of the first voltage stop circuit. The test voltage stop circuit 600 corresponds to an example of the second voltage stop circuit. The test voltage supply circuit 700 corresponds to an example of the second voltage supply circuit.

2-2-1. Configuration of Drive Voltage Supply Circuit

The drive voltage supply circuit 200 includes transistors Q21 and Q22, resistors R21 and R22, and a drive voltage delay circuit 201. The transistor Q21 corresponds to an example of the first switch and the first field effect transistor. The drive voltage delay circuit 201 corresponds to an example of the first delay circuit.

The transistor Q21 is composed of a p-type channel field effect transistor. A parasitic diode is coupled between the source and drain of the transistor Q21. A drive voltage supply line KDL to which a drive voltage is supplied is coupled to the source of the transistor Q21. A head coupling line HL1 coupled to the head voltage supply line HDL is coupled to the drain of the transistor Q21 via a node N1. The drive voltage supply line KDL corresponds to an example of the first voltage supply line.

When the transistor Q21 is turned ON, the drive voltage supply line KDL is electrically coupled to the respective heating elements 152 of the heating element unit 151A via the head coupling line HL1, the node N1, and the head voltage supply line HDL. On the other hand, when the transistor Q21 is turned OFF, the drive voltage supply line KDL is not electrically coupled to the respective heating elements 152 of the heating element unit 151A.

The gate of the transistor Q21 is coupled to a node N21. Resistors R21 and R22 are coupled to the node N21. The resistor R21 has one end coupled to the drive voltage supply line KDL and the other end coupled to the node N21. The resistor R22 has one end coupled to the node N21 and the other end coupled to the drain of the transistor Q22 composed of an n-type channel field effect transistor.

The transistor Q22 has the drain coupled to one end of the resistor R22, and the source grounded. A parasitic diode is coupled between the drain and the source of the transistor Q22. The gate of the transistor Q22 is coupled to the controller 10, and the drive voltage switch signal SWS1 is input based on the operation of the controller 10.

The drive voltage switch signal SWS1 is a signal whose voltage level is "High". Therefore, when the drive voltage switch signal SWS1 is input to the gate of the transistor Q22, the voltage of the gate with respect to the source is larger than the threshold value and the transistor Q22 is turned ON. On the other hand, the transistor Q22 is turned OFF without a potential difference between the source and the gate when the drive voltage switch signal SWS1 is not input to the gate.

When the transistor Q22 is turned ON, the divided voltage obtained from the resistor R21 and the resistor R22 is applied to the gate of the transistor Q21. The transistor Q21 is turned ON because the voltage of the source with respect to the gate is larger than the threshold value. The resistance values of the resistors R21 and R22 are appropriately determined in advance so that the transistor Q21 is turned ON when the transistor Q22 is turned ON. When the transistor Q21 is turned ON, the drive voltage supply line KDL and the heating element 152 are electrically coupled, so that the drive voltage supply circuit 200 supplies a drive voltage to the heating element 152. On the other hand, when the transistor Q22 is turned OFF, the divided voltage obtained from the resistor R21 and the resistor R22 is not applied to the gate of the transistor Q21, so that the transistor Q21 is turned OFF. When the transistor Q21 is turned OFF, the drive voltage supply line KDL and the heating element 152 are not electrically coupled, so that the drive voltage supply circuit 200 stops supplying the drive voltage to the heating element 152. In this way, the drive voltage supply circuit 200 turns ON the supply of the drive voltage to the heating element 152 when the drive voltage switch signal SWS1 is input, and turns OFF the supply of the drive voltage to the heating element 152 when the drive voltage switch signal SWS1 is not input.

A capacitor C21 is coupled in parallel to the resistor R21. The capacitor C21 and the resistor R22 constitute the drive voltage delay circuit 201. The operation and function of the drive voltage delay circuit 201 will be described later.

2-2-2. Configuration of Drive Voltage Stop Circuit

The drive voltage stop circuit 300 includes transistors Q31 and Q32 and resistors R31 and R32.

The transistor Q31 is composed of a pnp-type bipolar transistor, and has an emitter coupled to the drive voltage supply line KDL, a collector coupled to the node N21, and a base coupled to a node N31. Resistors R31 and R32 are coupled to the node N31. The resistor R31 has one end coupled to the emitter of the transistor Q31 and the other end coupled to the node N31. The resistor R32 has one end coupled to the node N31 and the other end coupled to the drain of the transistor Q32 composed of an n-type channel field effect transistor.

The transistor Q32 has the drain coupled to one end of the resistor R32 and the source grounded. A parasitic diode is coupled between the drain and the source of the transistor Q32. The gate of the transistor Q32 is coupled to the controller 10, and the test voltage switch signal SWS2 is input thereto based on the operation of the controller 10.

The test voltage switch signal SWS2 is a signal whose voltage level is "High". Therefore, when the test voltage switch signal SWS2 is input to the gate of the transistor Q32, the voltage of the gate with respect to the source is larger than the threshold value and the transistor Q32 is turned ON. On the other hand, the transistor Q32 is turned OFF without a potential difference between the source and the gate when the test voltage switch signal SWS2 is not input to the gate.

When the transistor Q32 is turned ON, the divided voltage obtained from the resistor R31 and the resistor R32 is applied to the base of the transistor Q31. The transistor Q31 is turned ON because the voltage of the emitter with respect to the base is larger than the threshold value. The resistance values of the resistors R31 and R32 are appropriately determined in advance so that the transistor Q31 is turned ON when the transistor Q32 is turned ON. When the transistor Q31 is turned ON, the transistor Q21 of the drive voltage supply circuit 200 is short-circuited between the gate and the source, and the transistor Q21 is turned OFF. Therefore, when the controller 10 inputs the test voltage switch signal SWS2 to the drive voltage stop circuit 300, the drive voltage stop circuit 300 can set or keep the transistor Q21 OFF, and during this time, sets or keeps the supply of the drive voltage to the heating element 152 OFF. On the other hand, when the transistor Q32 is turned OFF, the divided voltage obtained from the resistor R31 and the resistor R32 is not applied to the gate of the transistor Q31, so that the transistor Q31 is turned OFF. When the transistor Q31 is turned OFF, the transistor Q21 of the drive voltage supply circuit 200 is not short-circuited between the gate and the source. Therefore, the transistor Q21 can be turned ON/OFF when the controller 10 inputs the test voltage switch signal SWS2 to the drive voltage stop circuit 300. Therefore, when the controller 10 inputs the test voltage switch signal SWS2 to the drive voltage stop circuit 300, the drive voltage supply circuit 200 can supply the drive voltage to the heating element 152 due to the input of the drive voltage switch signal SWS1 based on the operation of the controller 10.

2-2-3. Configuration of Test Voltage Supply Switching Circuit

The test voltage supply switching circuit 400 includes transistors Q41 and Q42 and resistors R41 and R42.

The transistor Q41 is composed of a p-type channel field effect transistor. A parasitic diode is coupled between the source and the drain of the transistor Q41. The source of the transistor Q41 is coupled to a test voltage supply line KSL to which the test voltage is supplied, and the drain of the transistor Q41 is coupled to a head coupling line HL2 coupled to the head voltage supply line HDL via the node N1. A transistor Q51 of the backflow prevention circuit 500 is provided in series in the head coupling line HL2.

When the transistor Q41 is turned ON in a case where the transistor Q51 is turned ON, the test voltage supply line KSL is electrically coupled to the heating element 152 via the head coupling line HL2, the node N1, and the head voltage supply line HDL. The test voltage supply line KSL corresponds to an example of the second voltage supply line. On the other hand, when the transistor Q41 is turned OFF, the test voltage supply line KSL is not electrically coupled to the heating element 152.

The gate of transistor Q41 is coupled to a node N41. The resistors R41 and R42 are coupled to the node N41. The resistor R41 has one end coupled to the source of the transistor Q41 and the other end coupled to the node N41. The resistor R42 has one end coupled to the node N41 and the other end coupled to the drain of the transistor Q42 composed of an n-type channel field effect transistor.

The transistor Q42 has the drain coupled to one end of the resistor R42 and the source grounded. A parasitic diode is coupled between the drain and the source of the transistor Q42. The gate of the transistor Q42 is coupled to the controller 10, and the test voltage switch signal SWS2 is input thereto based on the operation of the controller 10. The transistor Q42 is turned ON when the test voltage switch signal SWS2 is input to the gate. On the other hand, the transistor Q42 is turned OFF when the test voltage switch signal SWS2 is not input to the gate.

When the transistor Q42 is turned ON, the divided voltage obtained from the resistor R41 and the resistor R42 is applied to the gate of the transistor Q41, and the transistor Q41 is turned ON. The resistance values of the resistors R41 and R42 are appropriately determined in advance so that the transistor Q41 is turned ON when the transistor Q42 is turned ON. When the transistor Q41 is turned ON, the test voltage supply line KSL and the heating element 152 are electrically coupled when the transistor Q51 of the backflow prevention circuit 500 is turned ON, so that the test voltage supply switching circuit 400 supplies the test voltage to the heating element 152. On the other hand, when the transistor Q42 is turned OFF, the divided voltage obtained from the resistor R41 and the resistor R42 is not applied to the gate of the transistor Q41, so the transistor Q41 is turned OFF. When the transistor Q41 is turned OFF, the test voltage supply line KSL and the heating element 152 are not electrically coupled, and the test voltage supply switching circuit 400 stops supplying the drive voltage to the heating element 152. In this way, the test voltage supply switching circuit 300 turns ON the supply of the test voltage to the heating element 152 when the test voltage switch signal SWS2 is input, and turns OFF the supply of the test voltage to the heating element 152 when no test voltage switch signal SWS2 is input.

The transistor Q41 is coupled to the test voltage supply line KSL via a node N42. A resistor R43 is provided in series with the test voltage supply line KSL. The controller 10 is coupled to the node N42. The node N42 outputs a test result signal KKS to the controller 10 when the test voltage supply switching circuit 400 supplies the test voltage to the thermal head 151. The test result signal KKS is a divided voltage, of the test voltage, obtained from by the resistor R43 and the heating element 152 to be tested.

2-2-4. Configuration of Backflow Prevention Circuit

The backflow prevention circuit 500 includes transistors Q51 and Q52, resistors R51 and R52, and a test voltage delay circuit 501. The test voltage delay circuit 501 corresponds to an example of the second delay circuit.

The transistor Q51 is composed of a p-type channel field effect transistor. The transistor Q51 corresponds to an example of the second switch and the second field effect transistor. The transistor Q51 is provided in the head coupling line HL2. A parasitic diode is coupled between the source and drain of the transistor Q51. The drain of the transistor Q51 is coupled to the drain of the transistor Q41 of the test voltage supply switching circuit 400, and the source of the transistor Q51 is coupled to the head voltage supply line HDL via the node N1.

The gate of transistor Q51 is coupled to a node N51. The resistors R51 and R52 are coupled to the node N51. The resistor R51 has one end coupled to the drain of the transistor Q51 and the other end coupled to the node N51. The resistor R52 has one end coupled to the node N51 and the other end coupled to the drain of the transistor Q52 composed of an n-type channel field effect transistor.

The transistor Q52 has the drain coupled to one end of the resistor R52 and the source grounded. A parasitic diode is coupled between the drain and the source of the transistor Q52. The gate of the transistor Q52 is coupled to the controller 10 via the resistor R53, and the test voltage switch signal SWS2 is input thereto.

The transistor Q52 is turned ON when the test voltage switch signal SWS2 is input to the gate via the test voltage delay circuit 501. On the other hand, the transistor Q52 is turned OFF when the drive voltage switch signal SWS1 is not input to the gate.

When the transistor Q52 is turned ON, the divided voltage obtained from the resistor R51 and the resistor R52 is applied to the gate of the transistor Q51, and the transistor Q51 is turned ON. The resistance values of the resistors R51 and R52 are appropriately determined in advance so that the transistor Q51 is turned ON when the transistor Q52 is turned ON. When the transistor Q51 is turned ON, the test voltage supply switching circuit 400 is coupled to the node N1. On the other hand, when the transistor Q52 is turned OFF, the divided voltage obtained from the resistor R51 and the resistor R52 is not applied to the gate of the transistor Q51, so that the transistor Q51 is turned OFF. When the transistor Q51 is turned OFF, the test voltage supply switching circuit 400 is not coupled to the node N1.

A capacitor C51 is coupled to one end of the resistor R53 and the gate of the transistor Q52. The capacitor C51 and the resistor R53 constitute the test voltage delay circuit 501. The operation and function of the test voltage delay circuit 501 will be described later.

2-2-5. Configuration of Test Voltage Stop Circuit

The test voltage stop circuit 600 includes transistors Q61 and Q62 and resistors R61 and R62.

The transistor Q61 is composed of a pnp-type bipolar transistor, the emitter is coupled to the source of the transistor Q51, the collector is coupled to the node N51, and the base is coupled to a node N61. Resistors R61 and R62 are coupled to the node N61. The resistor R61 has one end coupled to the emitter of the transistor Q61 and the other end coupled to the node N61. The resistor R62 has one end coupled to the node N61 and the other end coupled to the drain of the transistor Q62 composed of an n-type channel field effect transistor.

The transistor Q62 has the drain coupled to one end of the resistor R62, and the source grounded. A parasitic diode is coupled between the drain and the source of the transistor Q62. The gate of the transistor Q62 is coupled to the controller 10, and the drive voltage switch signal SWS1 is input thereto based on the operation of the controller 10. The transistor Q62 is turned ON when the drive voltage switch signal SWS1 is input to the gate. On the other hand, the transistor Q62 is turned OFF when the drive voltage switch signal SWS1 is not input to the gate.

When the transistor Q62 is turned ON, the divided voltage obtained from the resistor R61 and the resistor R62 is applied to the gate of the transistor Q61, and the transistor Q61 is turned ON. The resistance values of the resistors R61 and R62 are appropriately determined in advance so that the transistor Q61 is turned ON when the transistor Q62 is turned ON. When the transistor Q61 is turned ON, the transistor Q51 of the backflow prevention circuit 500 is short-circuited between the gate and the source, so that the transistor Q51 is turned OFF. Therefore, when the controller 10 inputs the drive voltage switch signal SWS1 to the test voltage stop circuit 600, the test voltage stop circuit 600 sets or keeps the transistor Q51 of the backflow prevention circuit 500 OFF and sets or keeps the supply of the test voltage to the heating element 152 OFF. On the other hand, when the transistor Q62 is turned OFF, the divided voltage obtained from the resistor R61 and the resistor R62 is not applied to the gate of the transistor Q61, so that the transistor Q61 is turned OFF. When the transistor Q61 is turned OFF, the transistor Q51 is not short-circuited between the gate and the source, so that the test voltage supply switching circuit 400 can supply the test voltage to the heating element 152 due to the input of the test voltage switch signal SWS2 based on the operation of the controller 10 and thereby.

3. Operation of Thermal Printer

Next, the operation of the thermal printer 1 related to the printing and the operation of the thermal printer 1 related to the heating element test will be described.

3-1. Operation of the Thermal Printer Related to Printing

Figure 3:
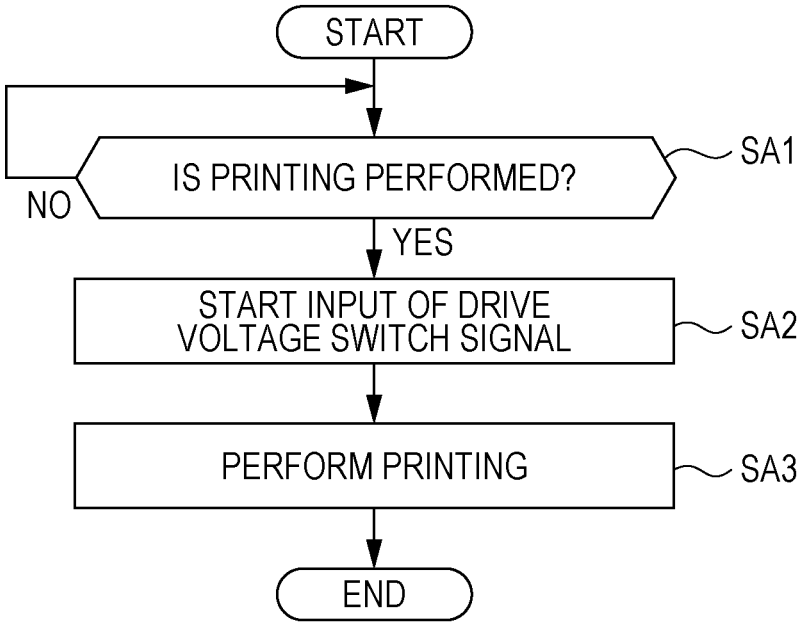
FIG. 3 is a flowchart showing the operation of the thermal printer.

FIG. 3 is a flowchart showing the operation of the thermal printer 1 related to the printing.

The controller 10 of the thermal printer 1 determines whether to perform printing by the printing unit 15 (step SA1). For example, when receiving the print data from the external device via the communication unit 11, the controller 10 makes an affirmative determination in step SA1.

When it is determined that printing is performed (step SA1: YES), the controller 10 starts to input the drive voltage switch signal SWS1 to the voltage supply circuit 153A (step SA2).

In step SA2, the controller 10 inputs the drive voltage switch signal SWS1 to the drive voltage supply circuit 200 and the test voltage stop circuit 600 in the voltage supply circuit 153A.

When the input of the drive voltage switch signal SWS1 is started, the transistor Q21 is turned ON, so that the drive voltage supply circuit 200 starts to supply the drive voltage to the heating element 152 of the thermal head 151. In addition, when the input of the drive voltage switch signal SWS1 is started, the test voltage stop circuit 600 sets or keeps the transistor Q51 of the backflow prevention circuit 500 OFF.

In this way, when the drive voltage switch signal SWS1 is input from the controller 10, the voltage supply circuit 153A starts the supply of the drive voltage by the drive voltage supply circuit 200 and turns OFF the transistor Q51 of the backflow prevention circuit 500. As a result, when the drive voltage is supplied to the heating element 152, the transistor Q51 is kept OFF even when the controller 10 outputs the test voltage switch signal SWS2 to the voltage supply circuit 153A due to a predetermined factor, so that the test voltage supply circuit 700 does not supply the test voltage to the heating element 152. Therefore, the voltage supply circuit 153A can reliably prevent the drive voltage and the test voltage from being supplied simultaneously to the heating element 152 when the thermal printer 1 is performing printing. Therefore, the voltage supply circuit 153A can avoid the occurrence of a situation in which a voltage exceeding the rating voltage is supplied to the heating element 152 by the simultaneous supplies. Further, when the drive voltage is supplied to the heating element 152, the transistor Q51 of the backflow prevention circuit 500 is kept OFF because the transistor Q61 of the test voltage stop circuit 600 is turned ON. Therefore, when the thermal printer 1 is performing printing, the transistor Q51 of the backflow prevention circuit 500 is not turned ON even when the controller 10 outputs the test voltage switch signal SWS2 due to a predetermined factor. Therefore, the voltage supply circuit 153A can reliably prevent the drive voltage from being supplied to the test voltage supply circuit 700 via the node N1, and can reliably prevent the excessive voltage exceed the rating voltage from being supplied to respective components of the logic circuit system such as the test voltage supply circuit 700 due to the drive voltage.

Returning to the description of the flowchart of FIG. 3, when the controller 10 starts to input the drive voltage switch signal SWS1 to the voltage supply circuit 153A, the controller 10 performs printing (step SA3). In step SA3, as described above, the controller 10 outputs the strobe signal S1, the latch signal S2, the clock signal S3, and the data signal S4 indicating the print data to the head drive circuit 153 to perform printing for each dot line.

3-2. Operation of Thermal Printer Related to Heating Element Test

Figure 4:
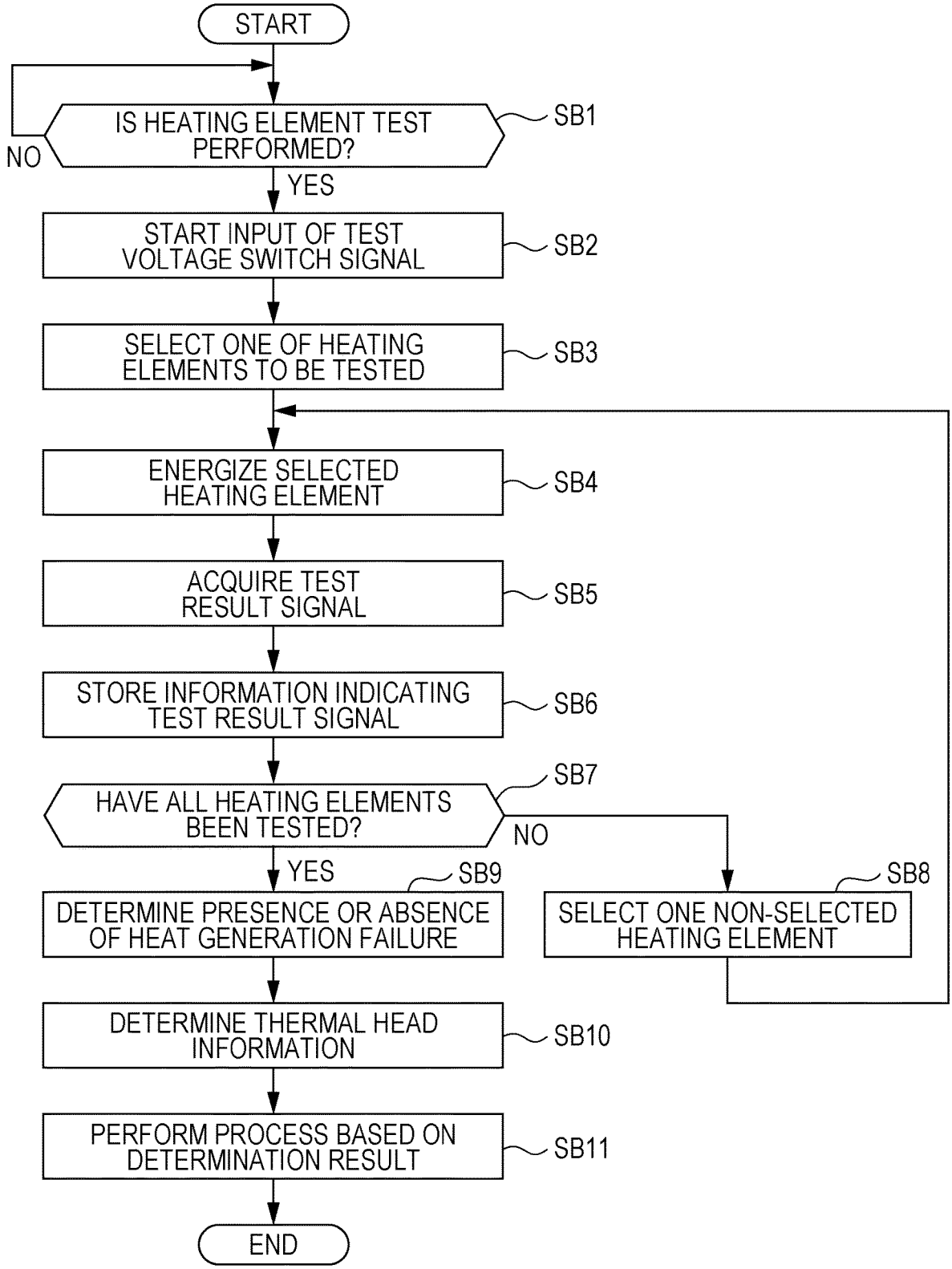
FIG. 4 is a flowchart showing the operation of the thermal printer.

FIG. 4 is a flowchart showing the operation of the thermal printer 1 related to the heating element test.

The controller 10 of the thermal printer 1 determines whether to perform the heating element test (step SB1). For example, when the input unit 12 detects an operation instructing performance of the heating element test, the controller 10 makes an affirmative determination in step SB1. For example, when the configuration is such that the test is automatically performed after the printing by the printing unit 15 is completed, the controller 10 makes an affirmative determination in step SB1 triggered by the completion of the printing.

When it is determined that the heating element test is performed (step SB1: YES), the controller 10 starts to input the test voltage switch signal SWS2 to the voltage supply circuit 153A (step SB2).

In step SB2, the controller 10 inputs the test voltage switch signal SWS2 to the test voltage supply switching circuit 400, the backflow prevention circuit 500, and the drive voltage stop circuit 300 in the voltage supply circuit 153A.

When the input of the test voltage switch signal SWS2 is started, the transistor Q51 is turned ON, so that the backflow prevention circuit 500 electrically couples the test voltage supply switching circuit 400 and the heating element 152. In the test voltage supply switching circuit 400, when the input of the test voltage switch signal SWS2 is started, the transistor Q41 is turned ON. As a result, the test voltage supply switching circuit 400 starts to supply the test voltage to the heating element 152. When the input of the test voltage switch signal SWS2 is started, the drive voltage stop circuit 300 turns OFF the transistor Q21 of the drive voltage supply circuit 200 and turns OFF the supply of the drive voltage to the heating element 152.

In this way, when the test voltage switch signal SWS2 is output from the controller 10, the voltage supply circuit 153A starts to supply the test voltage to the heating element 152 and sets or keeps the transistor Q21 OFF. As a result, when the test voltage is supplied to the heating element 152, the transistor Q21 is kept OFF even when the controller 10 outputs the drive voltage switch signal SWS1 to the voltage supply circuit 153A due to a predetermined factor, so that the drive voltage supply circuit 200 does not supply the drive voltage to the heating element 152. Therefore, the voltage supply circuit 153A can reliably prevent the drive voltage and the test voltage from being supplied simultaneously to the heating element 152 when the thermal printer 1 is performing the heating element test. Further, the drive voltage supply circuit 200 does not supply the drive voltage to the heating element 152 when supplying the test voltage to the heating element 152. Therefore, the voltage supply circuit 153A can reliably prevent the drive voltage from being supplied to the test voltage supply circuit 700 via the node N1 when the test voltage is supplied to the heating element 152, and the logic circuit system such as the test voltage supply circuit 700 from suffering from the failure due to the excessive voltage.

Returning to the description of the flowchart of FIG. 3, when the controller 10 starts to output the test voltage switch signal SWS2 to the voltage supply circuit 153A, the controller 10 selects one of the heating elements 152 to be tested (step SB3).

Next, the controller 10 outputs the data signal S4 for energizing the heating element 152 to be tested to the shift register 151C of the thermal head 151 to energize the selected heating element 152 (step SB4).

Next, the controller 10 acquires the test result signal KKS of the selected heating element 152 (step SB5). As described above, the test result signal KKS is a divided voltage obtained from the resistor R43 and the heating element 152 selected in step SB3.

When acquiring the test result signal KKS, the controller 10 performs the predetermined process such as a digital conversion on the test result signal KKS, and stores information indicating the test result signal KKS in the storage unit 110 (step SB6).

Next, the controller 10 determines whether all of the heating elements 152 included in the thermal head 151 have been tested (step SB7).

When it is determined that all of the heating elements 152 included in the heating element unit 151A are not tested (step SB7: NO), the controller 10 selects one heating element 152 that is not tested among the heating elements 152 included in the thermal head 151 (step SB8). The controller 10 returns the process to step SB4, and acquires the test result signal KKS of the heating element 152 selected by step SB8.

On the other hand, when it is determined that all of the heating elements 152 included in the heating element unit 151A have been tested (step SB7: YES), the controller 10 determines the presence or absence of a heat generation failure for each of the heating elements 152 included in the thermal head 151 based on the information indicating the test result signal KKS stored in the storage unit 110 (step SB9).

For example, in step SB9, the controller 10 determines whether the test result signal KKS indicates a voltage equal to or higher than a predetermined threshold voltage. When it is determined that the test result signal KKS indicates a voltage equal to or higher than a predetermined threshold, the controller 10 determines that the heating element 152 corresponding to the test result signal KKS has a heat generation failure. On the other hand, when it is determined that the test result signal KKS does not indicate a voltage equal to or higher than the predetermined threshold, the controller 10 determines that the heating element 152 corresponding to the test result signal KKS has no heat generation failure.

Next, the controller 10 determines the state of the thermal head 151 based on the determination result in step SB9 (step SB10). For example, in step SB10, when the number of the heating elements 152 determined to be defective in heat generation is a predetermined number or more, the controller 10 determines that the state of the thermal head 151 is in an abnormal state. On the other hand, when the number of the heating elements 152 determined to be defective in heat generation is below a predetermined number, the controller 10 determines that the state of the thermal head 151 is in a normal state.

Subsequently, the controller 10 performs the process based on the determination result in step SB10 (step SB11). For example, in step SB11, the controller 10 makes a notification of the determination result by the display unit 13.

4. Operation of Voltage Supply Circuit

Next, the operation of the voltage supply circuit 153A will be described in more detail by illustrating a plurality of input modes of the drive voltage switch signal SWS1 and the test voltage switch signal SWS2.

4-1. Example 1

In Example 1, the operation of the voltage supply circuit 153A when the controller 10 inputs the drive voltage switch signal SWS1 and the test voltage switch signal SWS2 to the voltage supply circuit 153A simultaneously due to a predetermined factor will be described.

Figure 5:
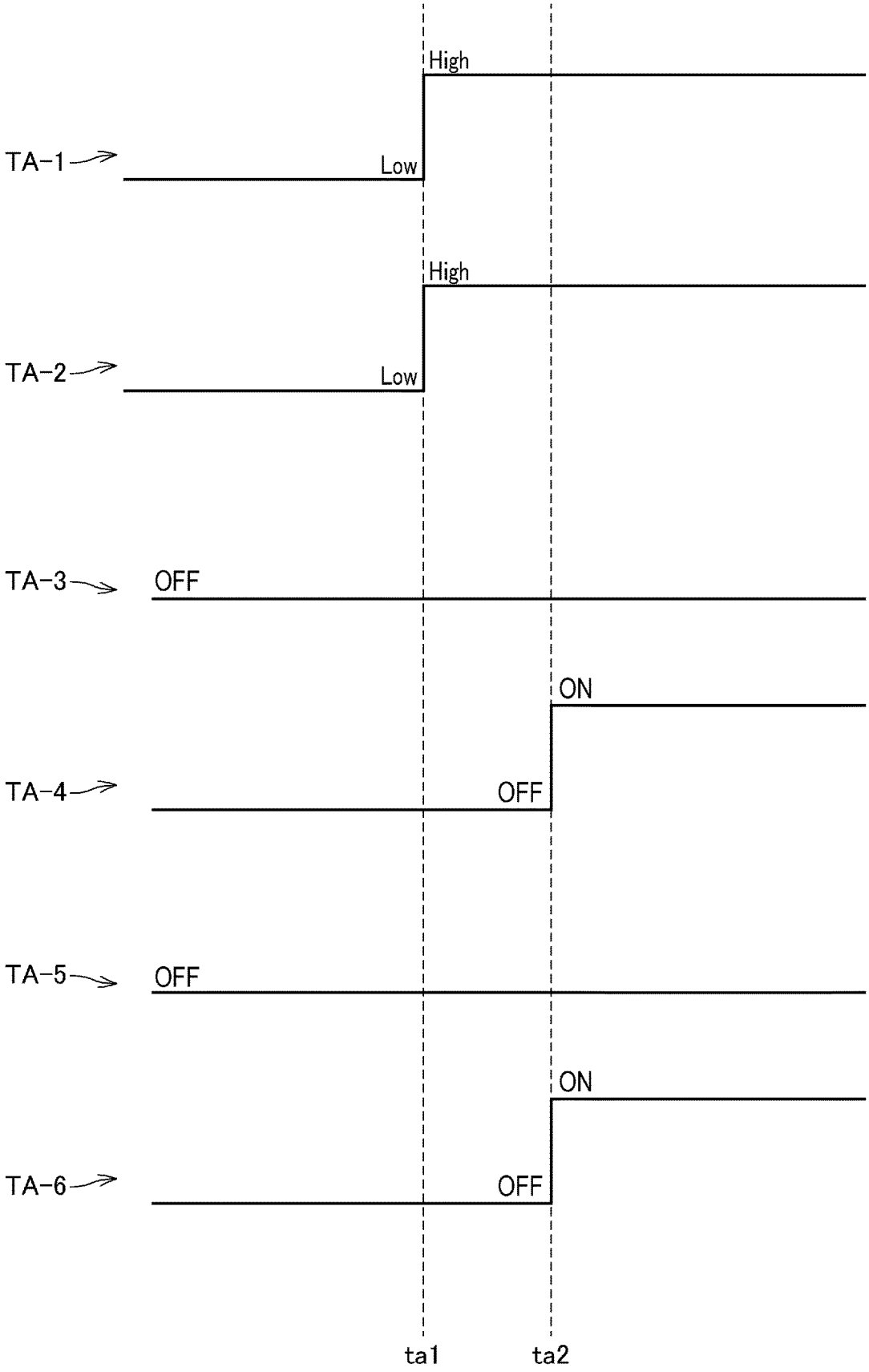
FIG. 5 is a timing chart showing switch signals and a transistor state.

FIG. 5 is a timing chart showing the input states of the drive voltage switch signal SWS1 and the test voltage switch signal SWS2 and the ON/OFF states of the transistors Q21, Q31, Q51, and Q61.

In FIG. 5, a timing chart TA-1 shows an input state of the drive voltage switch signal SWS1 to the voltage supply circuit 153A. A timing chart TA-2 shows an input state of the test voltage switch signal SWS2 to the voltage supply circuit 153A. In the timing charts TA-1 and TA-2, "Low" indicates that the input of the switch signal to the voltage supply circuit 153A is in the OFF state, and "High" indicates that the input of the switch signal to the voltage supply circuit 153A is in the ON state.

In FIG. 5, a timing chart TA-3 shows the ON/OFF state of the transistor Q21 of the drive voltage supply circuit 200. A timing chart TA-4 shows an ON/OFF state of the transistor Q31 of the drive voltage stop circuit 300. A timing chart TA-5 shows the ON/OFF state of transistor Q51 of backflow prevention circuit 500. A timing chart TA-6 shows the ON/OFF state of the transistor Q61 of the test voltage stop circuit 600.

As shown in FIG. 5, it is assumed that the controller 10 simultaneously inputs the drive voltage switch signal SWS1 and the test voltage switch signal SWS2 to the voltage supply circuit 153A at timing ta1 due to a predetermined factor.

Then, after timing ta1, the drive voltage switch signal SWS1 is input to the drive voltage supply circuit 200 with a delay by the drive voltage delay circuit 201. That is, since the charge storage by the capacitor C21 of the drive voltage delay circuit 201 is started, the application of a voltage equal to or higher than a threshold necessary for turning ON the transistor Q21 is delayed at the gate of the transistor Q21. As a result, as shown in the timing chart TA-3, the transistor Q21 is not turned ON quickly after timing ta1. After timing ta1, the test voltage switch signal SWS2 is input to the drive voltage stop circuit 300. However, while the ON state of the transistor Q21 is delayed, the transistor Q31 of the drive voltage stop circuit 300 is quickly turned ON after timing ta1. As a result, as shown in the timing chart TA-3, the transistor Q21 is short-circuited between the source and the gate, and continues to be turned OFF without being turned ON even after timing ta2 when the transistor Q31 is turned.

Further, after timing ta1, the test voltage switch signal SWS2 is input to the backflow prevention circuit 500 with a delay by the test voltage delay circuit 501. In other words, since the charge storage is started in the capacitor C51 of the test voltage delay circuit 501, application of a voltage exceeding a threshold necessary for turning ON the transistor Q52 is delayed at the gate of the transistor Q52. As a result, as shown in the timing chart TA-5, the transistor Q51 is not turned ON quickly after timing ta1. After timing ta1, the test voltage switch signal SWS2 is also input to the test voltage stop circuit 600. However, while the ON state of the transistor Q51 is delayed, the transistor Q61 of the test voltage stop circuit 600 is quickly turned ON after timing ta1 as shown in the timing chart TA-6. As a result, as shown in the timing chart TA-5, the transistor Q51 is short-circuited between the source and the gate, and continues to be turned OFF without being turned ON even after timing ta2 when the transistor Q61 is turned ON.

In this way, when the controller 10 inputs the drive voltage switch signal SWS1 and the test voltage switch signal SWS2 simultaneously to the voltage supply circuit 153A due to a predetermined factor, the transistor Q21 is not turned ON because there is the drive voltage delay circuit 201. In this case, the transistor Q51 is not turned ON because there is the test voltage delay circuit 501. Therefore, even when the controller 10 inputs the drive voltage switch signal SWS1 and the test voltage switch signal SWS2 simultaneously to the voltage supply circuit 153A due to a predetermined factor, the voltage supply circuit 153A can reliably prevent the drive voltage and the test voltage from being supplied simultaneously to the heating element 152. In addition, since the transistor Q51 of the backflow prevention circuit 500 is not turned ON, in the voltage supply circuit 153A, the drive voltage is supplied to the test voltage supply circuit 700 via the node N1 even when the respective switch signals are simultaneously input, so that the logic circuit system such as the test voltage supply circuit 700 can be prevented from being damaged due to an excessive voltage.

4-2. Example 2

In Example 2, the operation of the voltage supply circuit 153A in the case where the controller 10 turns ON the input of the test voltage switch signal SWS2 at the timing when the input of the drive voltage switch signal SWS1 is stopped when the heating element test is performed quickly after printing is performed will be described.

Figure 6:
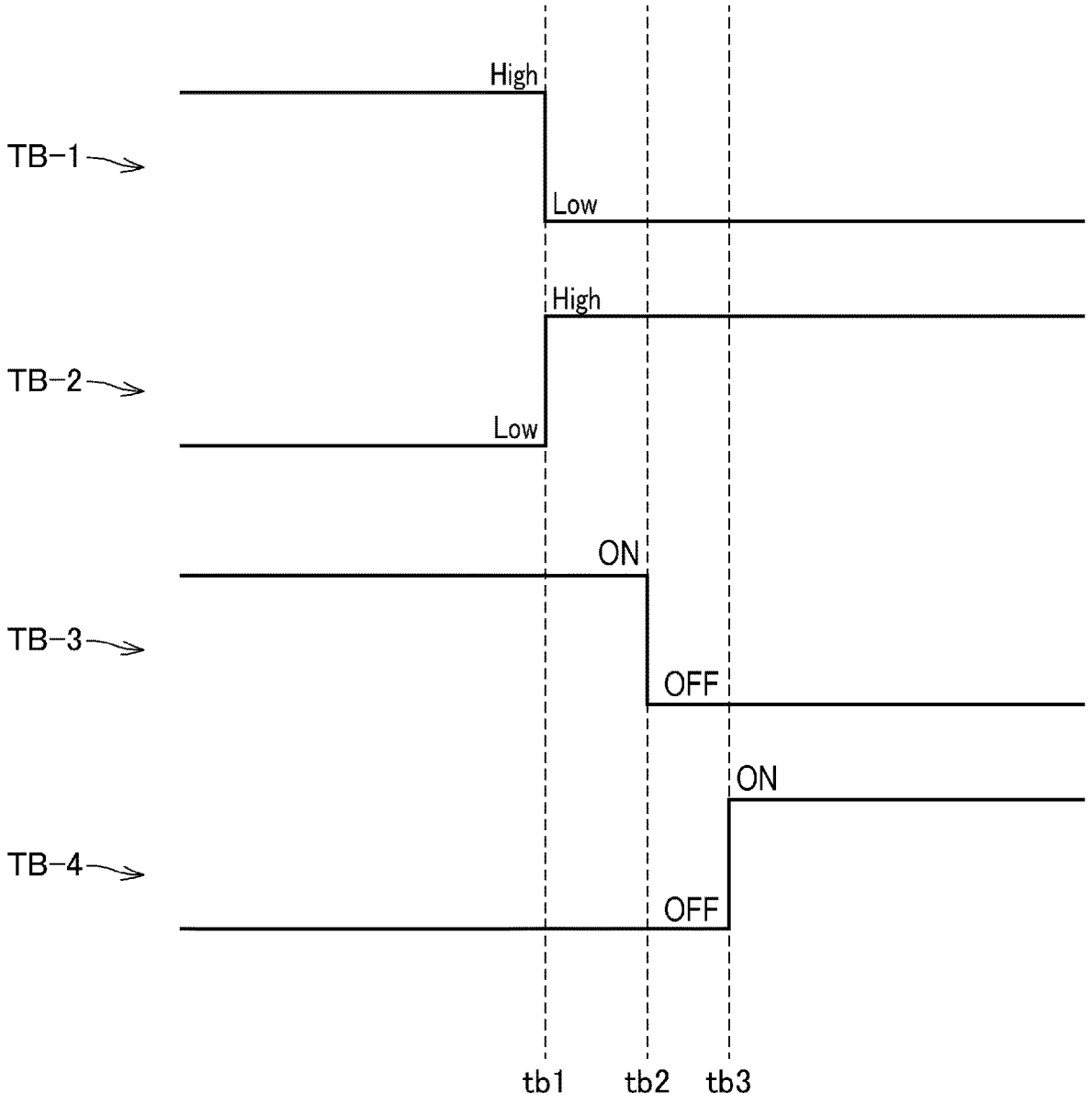
FIG. 6 is a timing chart showing switch signals and a transistor state.

FIG. 6 is a timing chart showing the input states of the drive voltage switch signal SWS1 and the test voltage switch signal SWS2, and the ON/OFF states of the transistors Q21 and Q51.

In FIG. 6, a timing chart TB-1 shows an input state of the drive voltage switch signal SWS1 to the voltage supply circuit 153A. A timing chart TB-2 shows an input state of the test voltage switch signal SWS2 to the voltage supply circuit 153A. In the timing charts TB-1 and TB-2, "Low" indicates that the input of the switch signal to the voltage supply circuit 153A is in the OFF state, and "High" indicates that the input of the switch signal to the voltage supply circuit 153A is in the ON state.

In FIG. 6, a timing chart TB-3 shows the ON/OFF state of the transistor Q21 of the drive voltage supply circuit 200. A timing chart TB-4 shows the ON/OFF state of the transistor Q51 of the backflow prevention circuit 500.

As shown in FIG. 6, it is assumed that the input of the drive voltage switch signal SWS1 to the voltage supply circuit 153A is turned OFF at timing tb1 and the input of the test voltage switch signal SWS2 to the voltage supply circuit 153A is turned ON at timing tb1.

After timing tb1, in the drive voltage supply circuit 200, QF31 is turned ON by the test voltage switch signal SWS2, and Q21 is quickly turned OFF at timing tb2.

Further, after timing tb1, the test voltage switch signal SWS2 is input to the backflow prevention circuit 500. However, since the charge storage is started in the capacitor C51 of the test voltage delay circuit 501, application of a voltage exceeding a threshold necessary for turning ON the transistor Q52 is delayed at the gate of the transistor Q52. As a result, as shown in the timing chart TB-4, the transistor Q51 is not turned ON until timing tb2 when the transistor Q21 is turned OFF, and is turned ON at timing tb3 with a delay from timing tb2.

In this way, when the controller 10 stops the input of the drive voltage switch signal SWS1 and turns ON the input of the test voltage switch signal SWS2, the transistor Q51 is not quickly turned ON because there is the test voltage delay circuit 501. The backflow prevention circuit 500 can turn ON the transistor Q51 after the transistor Q21 is turned OFF. Therefore, the voltage supply circuit 153A can prevent the transistor Q51 from being turned ON when the transistor Q21 is turned ON due to a transient phenomenon. Therefore, in the voltage supply circuit 153A, even when the controller 10 stops the input of the drive voltage switch signal SWS1 and turns ON the input of the test voltage switch signal SWS2, the drive voltage is supplied to the test voltage supply circuit 700 through the node N1, so that the logic circuit system such as the test voltage supply circuit 700 can be prevented from being damaged due to an excessive voltage.

4-3. Example 3

In Example 3, the operation of the voltage supply circuit 153A in the case where the controller 10 turns ON the input of the test voltage switch signal SWS2 at the timing when the input of the drive voltage switch signal SWS1 to the voltage supply circuit 153A is stopped when printing is performed quickly after the heating element test is performed will be described.

Figure 7:
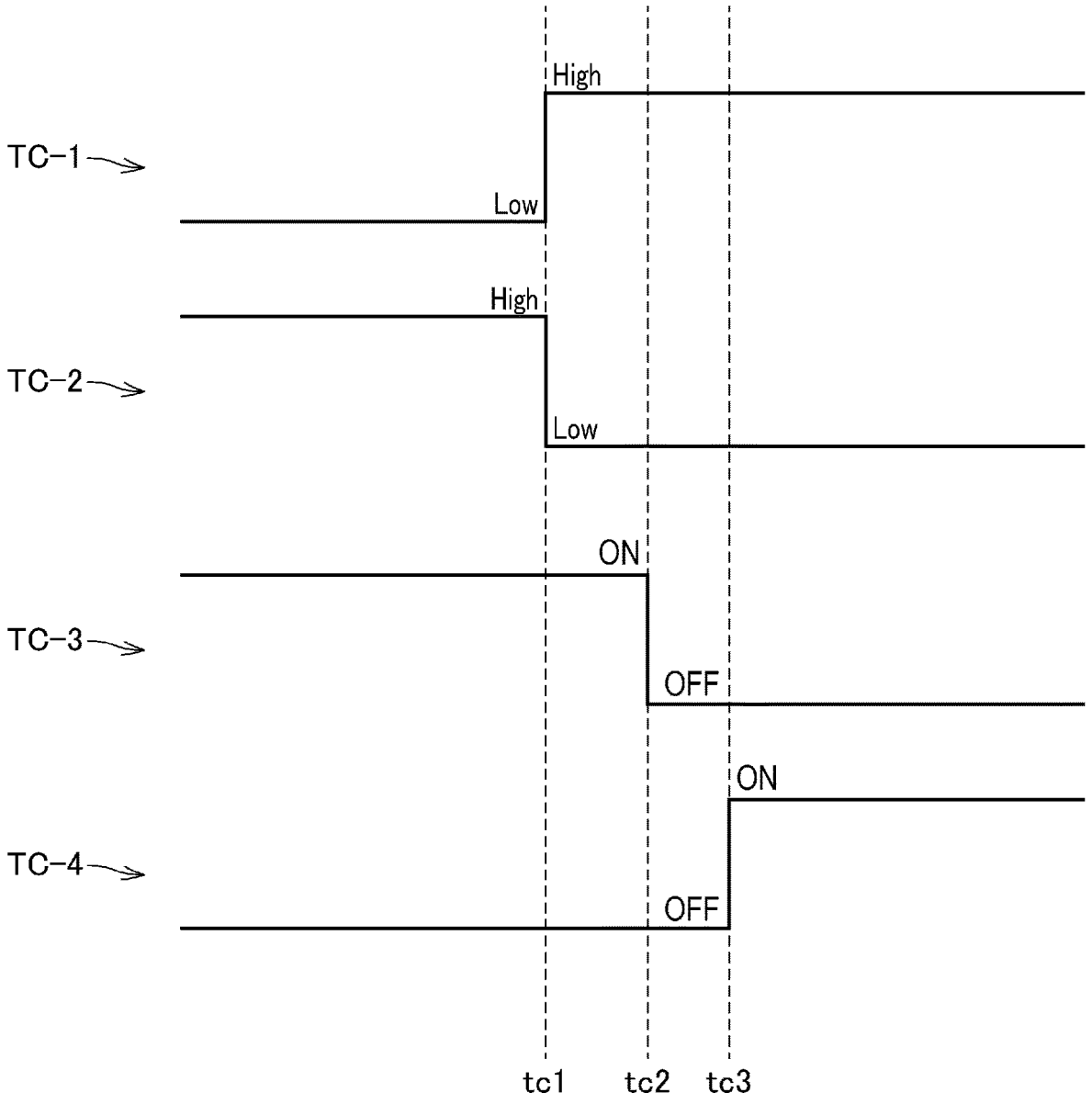
FIG. 7 is a timing chart showing switch signals and a transistor state.

FIG. 7 is a timing chart showing the input states of the drive voltage switch signal SWS1 and the test voltage switch signal SWS2 and the ON/OFF states of the transistors Q21 and Q51.

In FIG. 7, a timing chart TC-1 shows an input state of the drive voltage switch signal SWS1 to the voltage supply circuit 153A. A timing chart TC-2 shows an input state of the test voltage switch signal SWS2 to the voltage supply circuit 153A. In the timing charts TC-1 and TC-2, "Low" indicates that the input of the switch signal to the voltage supply circuit 153A is in the OFF state, and "High" indicates that the input of the switch signal to the voltage supply circuit 153A is in the ON state.

In FIG. 7, a timing chart TC-3 show the transistor Q51 of the backflow prevention circuit 500 is in the ON/OFF state. A timing chart TC-4 shows the transistor Q21 of the drive voltage supply circuit 200 in the ON/OFF state.

As shown in FIG. 7, it is assumed that the controller 10 turns OFF the input of the test voltage switch signal SWS2 and turns ON the input of the drive voltage switch signal SWS1 at timing tc1.

After timing tc1, in the backflow prevention circuit 500, Q61 is turned ON by the drive voltage switch signal SWS1, and Q51 is quickly turned OFF at tc3.

Further, after timing tc1, the drive voltage switch signal SWS1 is input to the drive voltage supply circuit 200 with a delayed by the drive voltage delay circuit 201. That is, since the charge storage is started in the capacitor C21 of the drive voltage delay circuit 201, application of a voltage exceeding a threshold necessary for turning ON the transistor Q21 is delayed at the gate of the transistor Q21. As a result, as shown in the timing chart TC-4, the transistor Q21 is not turned ON until timing tc2 when the transistor Q51 is turned OFF, and is turned ON at timing tc3 after the transistor Q51 is turned OFF.

In this way, when the controller 10 stops the input of the test voltage switch signal SWS2 and turns ON the input of the drive voltage switch signal SWS1, the transistor Q21 is not quickly turned ON because there is the drive voltage delay circuit 201. The transistor Q21 of the drive voltage supply circuit 200 can be turned ON after the transistor Q51 is turned OFF. Therefore, the voltage supply circuit 153A can prevent the transistor Q21 from being turned ON when the transistor Q51 is turned ON due to a transient phenomenon. Therefore, even when the controller 10 turns OFF the input of the test voltage switch signal SWS2 and turns ON the input of the drive voltage switch signal SWS1, in the voltage supply circuit 153A, the drive voltage is supplied to the test voltage supply circuit 700 via the node N1, so that the logic circuit system such as the test voltage supply circuit 700 can be prevented from being damaged due to an excessive voltage.

As described above, the thermal printer 1 includes the thermal head 151 including the heating element 152 and the voltage supply circuit 153A configured to supply the heating element 152 with a drive voltage and a test voltage lower than the drive voltage. The voltage supply circuit 153A includes the drive voltage supply circuit 200 that is coupled to the heating element 152 and that turns ON the supply of the drive voltage to the heating element 152 in response to the input of the drive voltage switch signal SWS1. The voltage supply circuit 153A includes the test voltage supply circuit 700 that is coupled to the heating element 152 and that turns ON the supply of the test voltage to the heating element 152 in response to the input of the test voltage switch signal SWS2. Further, the voltage supply circuit 153A includes the drive voltage stop circuit 300 setting or keeping the supply of the drive voltage of the drive voltage supply circuit 200 OFF in response to the input of the test voltage switch signal SWS2, and the test voltage stop circuit 600 setting or keeping the supply of the test voltage of the test voltage supply circuit 700 OFF in response to the input of the drive voltage switch signal SWS1.

In the control method of the thermal printer 1, printing is performed by supplying the drive voltage switch signal SWS1 from the voltage supply circuit 153A to the heating element 152 of the thermal head 151, and the test for the heating element 152 is performed by supplying the test voltage switch signal SWS2 to the heating element 152. In the control method of the thermal printer 1, the voltage supply circuit 153A turns ON the supply of the drive voltage to the heating element 152 in response to the input of the drive voltage switch signal SWS1 and sets or keeps the supply of the test voltage OFF, and turns ON the supply of the test voltage to the heating element 152 in response to the input of the test voltage switch signal SWS2 and sets or keeps the supply of the drive voltage OFF.

According to the configuration of the thermal printer 1 and the control method of the thermal printer 1, the voltage supply circuit 153A can turn OFF the supply of the test voltage to the heating element 152 when supplying the drive voltage to the heating element 152, and can turn OFF the supply of the drive voltage to the heating element 152 when supplying the test voltage to the heating element 152. Therefore, the voltage supply circuit 153A can reliably prevent the drive voltage and the test voltage from being supplied simultaneously to the heating element 152 to suffer from the failure, and can appropriately supply the drive voltage and the test voltage to the heating element 152.

The thermal printer 1 includes the drive voltage delay circuit 201 delaying an input of the drive voltage switch signal SWS1 to the drive voltage supply circuit 200.

According to this configuration, since the supply of the drive voltage by the drive voltage switch signal SWS1 can be delayed and switched to the ON state by the drive voltage delay circuit 201, the drive voltage is can be supplied to the heating element 152 after the supply of the test voltage is turned OFF. Therefore, the voltage supply circuit 153A can reliably prevent the drive voltage and the test voltage from being supplied simultaneously to the heating element 152 to suffer from the failure.

The thermal printer 1 includes the test voltage delay circuit 501 delaying an input of the test voltage switch signal SWS2 to the test voltage supply circuit 700.

According to this configuration, since the supply of the test voltage by the test voltage switch signal SWS2 can be delayed and switched to the ON state by the test voltage delay circuit 501, the test voltage can be supplied to the heating element 152 after the supply of the drive voltage is turned OFF. Therefore, the voltage supply circuit 153A can reliably prevent the drive voltage and the test voltage from being supplied simultaneously to the heating element 152 to suffer from the failure.

The voltage supply circuit 153A is coupled to the drive voltage supply line KDL to which the drive voltage is supplied and the test voltage supply line KSL for supplying the test voltage. The drive voltage supply circuit 200 includes the transistor Q21 that is switched to the ON state in response to the drive voltage switch signal SWS1, and couples the heating element 152 to the drive voltage supply line KDL when the transistor Q21 is turned ON. The test voltage supply circuit 700 includes a transistor Q51 that is switched to the ON state in response to a drive signal, and couples the heating element 152 to the test voltage supply line KSL when the transistor Q51 is turned ON. The drive voltage stop circuit 300 sets or keeps the transistor Q21 OFF in response to the input of the test voltage switch signal SWS2. The test voltage stop circuit 600 sets or keeps the transistor Q51 OFF in response to the input of the test voltage switch signal SWS2.

According to this configuration, since the drive voltage and the test voltage can be appropriately supplied to the heating element 152 by turning ON/OFF the transistors Q21 and Q51, the voltage supply circuit 153A in which the operation of appropriately supplying the drive voltage and the test voltage to the heating element 152 is performed can be established by a simple configuration.

The transistor Q21 is composed of a field effect transistor. The drive voltage stop circuit 300 sets or keeps the transistor Q21 OFF when the input of the test voltage switch signal SWS2 is in the ON state.

According to this configuration, by using a field effect transistor as the transistor Q21, it is possible to reduce power consumption in the voltage supply circuit 153A and the occurrence of malfunction of the transistor Q21 due to heat generation, compared with a case where, for example, a bipolar transistor is used. As a result, the voltage supply circuit 153A can more reliably prevent the drive voltage from being supplied to the heating element 152 when the test voltage is supplied to suffer from the failure while reducing the power consumption.

The transistor Q51 is composed of a field effect transistor. The test voltage stop circuit 600 sets or keeps the transistor Q51 OFF when the input of the drive voltage switch signal SWS1 is in the ON state.

According to this configuration, by using a field effect transistor as the transistor Q51, it is possible to reduce power consumption in the voltage supply circuit 153A, for example, compared with a case where a bipolar transistor is used.

The transistors Q21 and Q51 are coupled to the node N1 which is a common contact coupled to the heating element 152.

According to this configuration, it is possible to reliably prevent the drive voltage from being supplied to the test voltage supply circuit 700 via the node N1 to suffer from the failure.

The thermal printer 1 includes a controller 10 controlling the drive voltage switch signal SWS1 and the test voltage switch signal SWS2 in the voltage supply circuit 153A.

According to this configuration, the voltage supply circuit 153*a* can appropriately supply the drive voltage and the test voltage to the heating element 152 without depending on the input mode of the drive voltage switch signal SWS1 and the test voltage switch signal SWS2 by the controller 10.

5. Other Embodiments

The embodiment described above is merely an aspect of the present disclosure, and any modification and application can be made within the scope of the present disclosure.

For example, in the above-described embodiment, the head drive circuit 153 is configured to output the strobe signal S1, the latch signal S2, the clock signal S3, and the data signal S4 to the thermal head 151. The voltage supply circuit 153A may be configured to output these signals to the thermal head 151.

Further, for example, the above-described embodiment illustrates the case where the transistors Q31 and Q61 are configured by a pnp-type bipolar transistor, but they may be configured by a p-type channel field effect transistor.

Further, for example, the above-described embodiment illustrates the configuration in which the test voltage delay circuit 501 is coupled to the gate of the transistor Q51, but the test voltage delay circuit 501 may be configured to be also coupled to the gate of the transistor Q42. The drive voltage delay circuit 201 may be configured to be coupled to the gate of the transistor Q22 as in the test voltage delay circuit 501.

The function of the controller 10 may be implemented by a plurality of processors or a semiconductor chip.

Moreover, the respective sections shown in FIG. 1 is an example, and the specific mounting form is not limited in particular. That is, it is not always necessary to implement hardware corresponding to respective sections, but it is of course possible to construct a configuration in which the functions of the respective sections are implemented by executing a program by one processor. In addition, in the above embodiments, part of the functions implemented by software may be implemented by hardware, or part of the functions implemented by hardware may be implemented by software. In addition, specific detailed configurations of other sections of the thermal printer 1 can be changed in any manner without departing from the scope of the present disclosure.

Further, for example, the step units of the operations shown in FIGS. 3 and 4 are divided in accordance with the main processing contents in order to facilitate understanding of the operations of the respective sections of the thermal printer 1. Thus, the present disclosure is not limited to how the processing is divided into process units or the names of the process units. Depending on the processing contents, the process may be divided into more step units. Further, one step unit may be divided so as to include more processes. In addition, the order of the steps may be changed as appropriate within the scope of the present disclosure.

Further, for example, in the above-described embodiment, the circuit configuration shown in FIG. 2 is an example, and the configuration change such as replacement of the circuit elements shown in the drawing with the same number or different numbers of ICs is possible, and any change is possible in the range of the present disclosure.

For example, in the above-described embodiment, the printing apparatus is exemplified as the thermal printer 1, but the printing apparatus is not limited to the thermal printer 1. The present disclosure can be applied to an ink jet printer or a dot impact printer.

What is claimed is:

1. A printing apparatus comprising:

a print head including a head element; and a voltage supply circuit configured to supply, to the head element, a first voltage and a second voltage lower than the first voltage, wherein the voltage supply circuit includes a first voltage supply circuit that is coupled to the head element and that turns ON a supply of the first voltage to the head element in response to an input of a first signal, a second voltage supply circuit that is coupled to the head element and that turns ON a supply of the second voltage to the head element in response to an input of a second signal, a first voltage stop circuit setting a supply of the first voltage of the first voltage supply circuit OFF in response to an input of the second signal, and a second voltage stop circuit setting a supply of the second voltage of the second voltage supply circuit OFF in response to an input of the first signal, wherein, the voltage supply circuit is coupled to a first voltage supply line to which the first voltage is supplied and a second voltage supply line for supplying the second voltage, wherein, the first voltage supply circuit includes a first switch turning ON in response to the first signal and couples the head element to the first voltage supply line when the first switch is in an ON state, wherein, the second voltage supply circuit includes a second switch turning ON in response to the second signal and couples the head element to the second voltage supply line when the second switch is in an ON state, and wherein, the first voltage stop circuit sets the first switch OFF in response to an input of the second signal, and wherein the second voltage stop circuit sets the second switch OFF in response to an input of the first signal.

2. The printing apparatus according to claim 1, further comprising:

a first delay circuit delaying an input of the first signal to the first voltage supply circuit.

3. The printing apparatus according to claim 1, further comprising:

a second delay circuit delaying an input of the second signal to the second voltage supply circuit.

4. The printing apparatus according to claim 1, wherein the first switch is composed of a first field effect transistor, and wherein the first voltage stop circuit sets the first field effect transistor OFF when an input of the second signal is in an ON state.

5. The printing apparatus according to claim 1, wherein the second switch is composed of a second field effect transistor, and wherein the second voltage stop circuit sets the second field effect transistor OFF when an input of the first signal is in an ON state.

6. The printing apparatus according to claim 1, wherein the first switch and the second switch are coupled to a common contact coupled to the head element.

7. The printing apparatus according to claim 1, further comprising:

a control circuit controlling the first signal and the second signal each of which is input to the voltage supply circuit.

* * * * *